United States Patent [19]

Hemond et al.

[11] Patent Number: 4,463,454

[45] Date of Patent: Jul. 31, 1984

[54] SONAR VIBRATION ISOLATION TRANSDUCER MOUNT

[75] Inventors: Harold C. Hemond, Ledyard; William H. Ezell, New London, both of Conn.

[73] Assignee: Rockwell International Corporation, El Segundo, Calif.

[21] Appl. No.: 260,564

[22] Filed: May 5, 1981

[51] Int. Cl.[3] ..... H04R 17/00

[52] U.S. Cl. ..... 367/173; 367/153; 114/20 R

[58] Field of Search ..... 367/140, 141, 158, 155, 367/165, 166, 167, 171, 172, 174, 173, 176, 164; 335/306; 269/8 R; 308/108; 114/20 R, 23; 248/206 A, 309.4, 206.5; 74/5.46

[56] References Cited

U.S. PATENT DOCUMENTS

| | | | |
|---|---|---|---|
| 2,452,068 | 1/1943 | Peterson | 177/386 |
| 2,473,971 | 6/1949 | Ross | 367/155 X |
| 2,889,796 | 6/1959 | Williams et al. | 114/20 |
| 2,913,701 | 11/1959 | Wachholz | 340/17 |
| 3,082,401 | 3/1963 | Bland et al. | 367/156 |
| 3,146,038 | 8/1964 | Lautzenhiser | 308/10 |
| 3,337,844 | 8/1967 | Baltakis | 367/165 |
| 3,372,662 | 3/1968 | Nisewahger | 114/20 |
| 3,489,995 | 1/1970 | Laurent | 367/172 |
| 3,597,022 | 8/1971 | Waldron | 308/10 |
| 3,614,180 | 10/1971 | Beer | 308/10 |
| 3,663,934 | 5/1972 | Whitehouse et al. | 340/8 |
| 3,779,618 | 12/1973 | Soglia et al. | 308/10 |
| 3,955,858 | 5/1976 | Poubeau | 308/10 |
| 4,040,681 | 8/1977 | Heide | 308/10 |
| 4,192,246 | 3/1980 | Hodges et al. | 114/20 R |
| 4,244,629 | 1/1981 | Habermann | 308/10 |
| 4,256,352 | 3/1981 | Petrak et al. | 308/10 |

FOREIGN PATENT DOCUMENTS

| | | | |
|---|---|---|---|
| 1185930 | 3/1970 | United Kingdom | 248/309.4 |
| 1524858 | 9/1978 | United Kingdom | 102/517 |

*Primary Examiner*—Harold J. Tudor

*Attorney, Agent, or Firm*—H. Fredrick Hamann; James F. Kirk

[57] ABSTRACT

An apparatus for supporting in a housing, a mount adapted to carry a transducer, the mount having a predetermined positional locus, the apparatus comprising: cooperating sets of magnets attached to the mount and the housing, respectively the sets of magnets acting to positionally bias the mount toward an equilibrium position within the predetermined locus and freely of housing vibration transmittal to the mount.

17 Claims, 9 Drawing Figures

SONAR VIBRATION ISOLATION TRANSDUCER MOUNT

BACKGROUND OF THE INVENTION

1. Field of the Invention

This invention relates to the field of vibration isolation mounting systems used to join adjacent bodies and which attenuate the transmission of mechanical vibration and acoustical energy from one body to another, and particularly to the field of sonar sensor mounting systems.

2. Description of the Prior Art

Sonar transducers are employed in underwater marine vehicle guidance applications to both transmit and receive vibrations in predetermined bandwidths. Received vibrations emanate from both intended sources and from unintended noise sources. Received noise from unintended sources tends to mask the information contained in those vibrations from intended sources. The benefit of increased sonar transducer sensitivity or receiver amplifier sensitivity is diminished in a system incapable of discriminating between a signal and noise because the noise content is amplified along with the signal information. Mechanical and acoustical isolation of the sensors from acoustical noise sources within the vehicle improves the signal to noise ratio thereby improving the resolution and sensitivity of a system using electrical signals from the affected transducers.

Isolation mounting systems typically comprise a mount or supported mass to which the sensors are attached, a housing or base in rigid contact with the vehicle structure and a non-rigid or flexible support or linkage means or structure between the housing and mount. The support or linkage means or structure is typically fabricated from rubber or other elastomeric medium selected to attenuate or impare the transmission of acoustical energy from the vehicle housing to the mount.

SUMMARY OF THE INVENTION

It is a major objective of this invention to provide a sonar mount capable of reducing the level of noise received from unintended mechanical sources within, on and outside of a marine vehicle.

Another objective of this invention is to provide an apparatus for mounting necessarily noisy mechanical accessories within a marine vehicle so as to achieve substantial attenuation of noise transmitted from these noise sources to a sonar mount also mounted within the marine vehicle or to sonar receivers external to the marine vehicle.

These and other objectives of the invention are realized in an apparatus for supporting in a housing, a mount adapted to carry a transducer, the mount having a predetermined positional locus, the apparatus comprising: cooperating sets of magnets attached to the mount and the housing respectively, the sets of magnets acting to positionally bias the mount toward an equilibrium position within the predetermined locus and freely of housing vibration transmittal to the mounting.

In a more particular embodiment, one or more magnets of the subsets of magnets are permanent magnets, electro magnets, or antimagnetics formed of diamagnetic material. In another more particular embodiment, the invention apparatus includes also a marine vehicle, the vehicle having an outer echo sensitive surface, an inner echo sensitive surface, a chamber, said chamber containing the housing, a mounting being positioned within the housing and being relatively free of acoustical coupling between the housing and mount; transducers, the transducers being positioned on the transducer mounting surface.

Another embodiment of the invention provides cooperating sets of magnets, that are mutually repelling, each set of cooperating magnets having at least one magnet attached to the mount and adapted and arranged to mutually repel one or more magnets attached to the housing, the sets of magnets acting to bias the mount toward the equilibrium position within the predetermined locus and freely of housing vibration transmittal to the mounting.

In yet another more particular embodiment of the foregoing, the magnets are mutually repelling and are arranged in pairs, opposite polarity magnets being attached to the mount and housing respectively, each magnet pair acting to provide a localized repulsive force between the mount and the housing, the force positionally biasing the mount toward an equilibriam position.

In another embodiment, the foregoing invention apparatus further comprises at least one radial magnet subset wherein each radial magnet subset comprises one or more magnets attached to the mount and one or more magnets attached to the housing and adapted and arranged to provide restoring torque to the mount with respect to the housing to bias the mount toward an equilibrium position.

And in another even more particular embodiment, the invention apparatus housing defines a cylindrical cavity having an aperture, and inner cylindrical surface and a base; wherein the mount is disposed within the cylindrical cavity and comprises a cylindrical mask having a transducer mounting surface, a mount cylindrical surface opposing the cavity inner cylindrical surface, and a thrust support base opposing the cylindrical cavity base, each radial magnet subset having at least one inner radial magnet attached to the mount cylindrical surface, and at least one outer radial magnet attached to the cavity inner cylindrical surface, the inner and outer radial magnets forming concentric arrays of opposing subset magnets, each subset of magnets acting to bias the mount toward the equilibrium position.

And in another even more particular embodiment, the foregoing apparatus further comprises an axially disposed array of magnet subsets, each axial magnet subset having one or more magnets being attached to the thrust support base and one or more magnets being attached to the cylindrical cavity base, the axial array of magnet subsets acting to position the mount thrust support base axially from the cavity base toward the equilibrium position.

In another embodiment of the invention, the housing defines a conical cavity having an aperture, and inner conical cavity; wherein the mount is disposed within the conical cavity and comprises a conical mask having a transducer mounting surface, a mount thrust support conical surface, the mount thrust support conical surface opposing the inner conical cavity surface, each magnet subset having at least one inner radial magnet attached to the mount thrust support conical surface, and at least one outer radial magnet attached to the inner conical cavity surface, the inner and outer radial magnets forming concentric conical arrays of opposing subset magnets, each subset of magnets adapted and arranged to mutually repel and to provide restoring torque to the mount with respect to the housing and to bias the mount toward an equilibrium position.

In yet still another embodiment, the invention apparatus includes spacer means to concentrically and axially position the cylindrical mount and to provide a seal at the housing forward circular aperture, the spacer means providing radial and axial restoring force in response to radial or axial mount displacement in relation to the housing thereby biasing the mount toward an equilibrium position.

In another embodiment of the foregoing apparatus, the complying spacer means to concentrically and radially position the cylindrical mount within the housing at the housing forward circular aperature further comprises at least one circular elastomer seal positioned to bias the mount toward an equilibrium position.

In another even more particular embodiment, the foregoing invention apparatus includes also a marine vehicle having an outer echo sensitive surface, an inner echo sensitive surface, a chamber, the chamber containing the housing, the mounting being positioned within the housing and being relatively free of acoustical coupling between the housing and mount; transducers, the transducers being positioned on the transducer mounting surface, the chamber being filled with a medium to provide an acoustical matched coupling between the inner echo sensitive surface and the transducers.

In still yet another even more particular embodiment, the foregoing invention mount thrust support base is recessed and wherein the housing cavity base has at least one registration pin, the mount thrust support base recess being adapted to receive the registration pin the pin interlocking with the recess and adapted to provide mechanical registration of the mount in relation to the housing, limiting the mount rotational and translational freedom within the housing and providing magnet pair alignment.

In another embodiment, one or more of the magnet pairs in the foregoing invention are electromagnets. And in a more particular embodiment, the electromagnets are controlled by control means for the electromagnet pairs to bias the mount toward an equilibrium position.

In another more particular embodiment, the invention apparatus comprises means for providing pressure equilibrium between the chamber and all regions between the mount and the housing.

In the most particular embodiment of the invention, the registration pin is loosely keyed to the mount to limit the mount rotational freedom, and in another more particular embodiment, the keyed relationship between the pin and the mount is adjustable to permit maximization of rotational freedom under quiescent or transient shock conditions.

BRIEF DESCRIPTION OF THE DRAWINGS

The invention will be further described as to an illustrative embodiment in conjunction with the accompanying drawings in which.

DESCRIPTION OF THE PREFERRED EMBODIMENT

Figure 1:
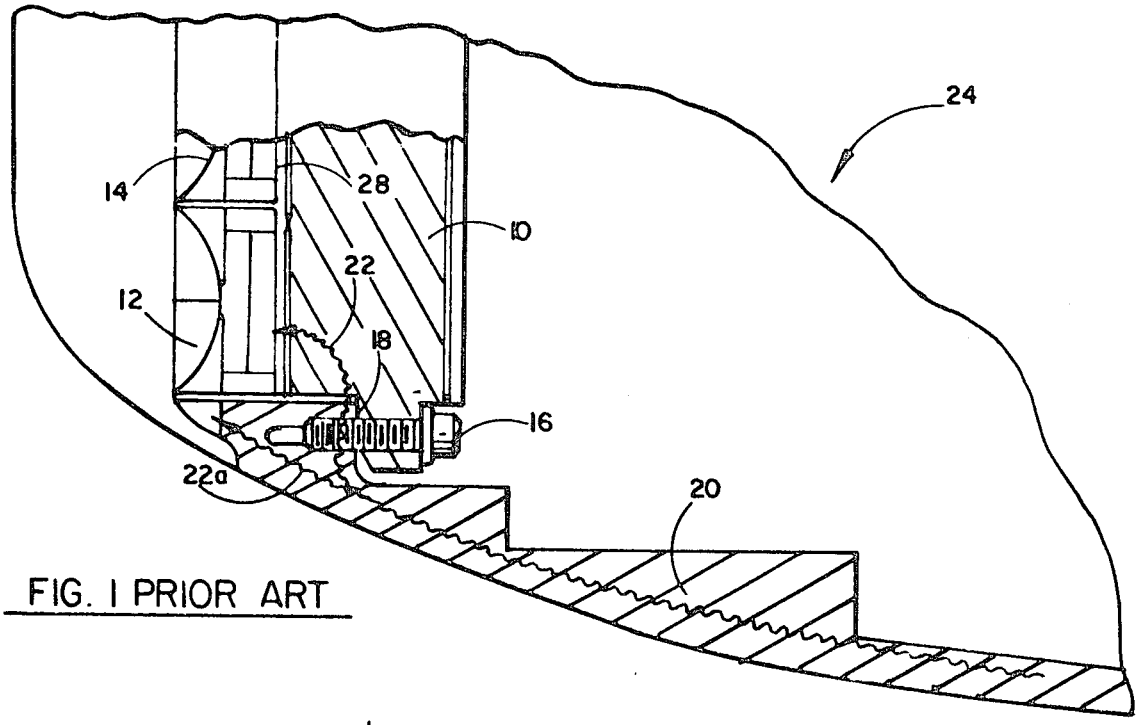
FIG. 1 PRIOR ART
FIG. 1 is a view of a prior art sonar mount adapted to carry transducers and bolted to a flange within a marine vehicle.

Referring now to FIG. 1, there is shown a side sectional view of a marine vehicle 20, having flange 18 to which a prior art sonar mount 10 is fastened by bolt 16. Marine vehicle 20 provides an acoustical transmision path represented by arrows 22, 22*a* for transmitting undesired acoustical noise signals from engine propeller, surface cavitation and other sources within or on the structure 24 throught the mount 10 to the mounting bases 26, 28 of the transducers 12, 14.

Figure 2:
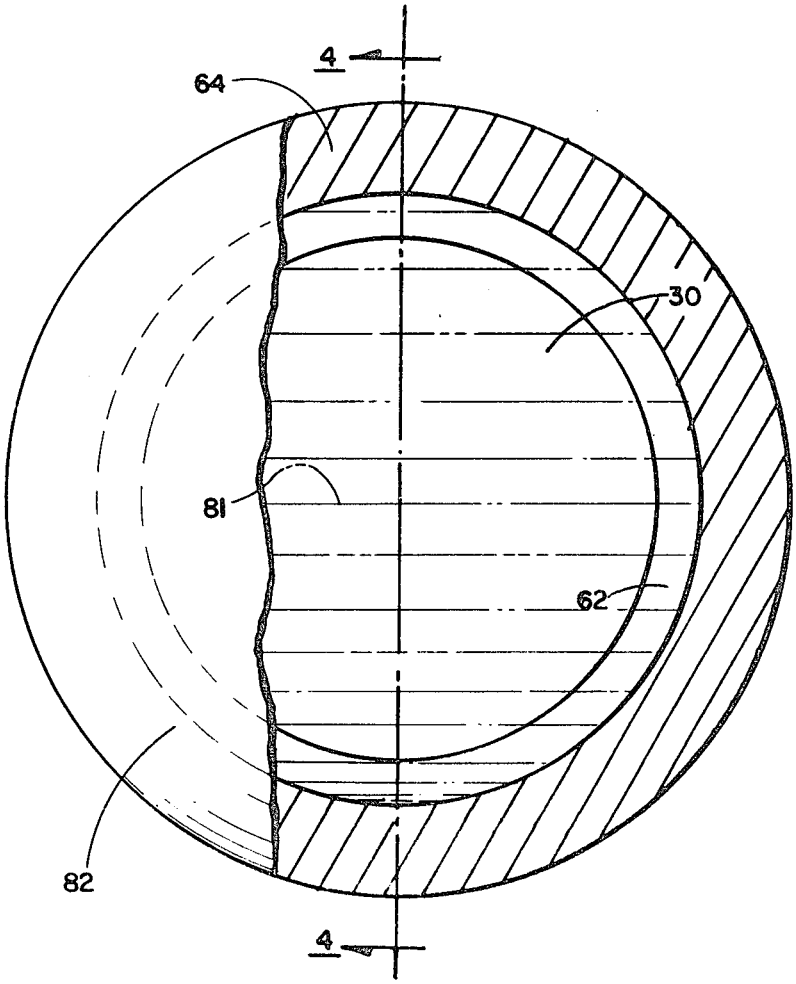
FIG. 2 is a front elevation view of the invention sonar vibration isolation transducer mount within the sectional hull of a marine vehicle.
Figure 3:
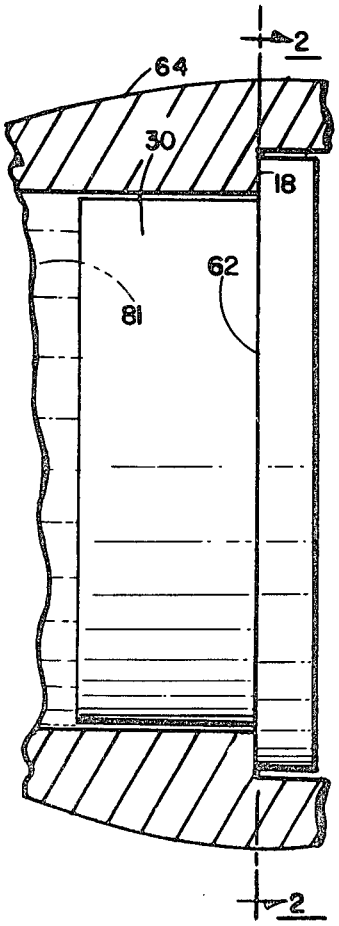
FIG. 3 is a side elevation view of the invention sonar vibration isolation transducer mount within the sectioned hull of a marine vehicle.
Figure 4:
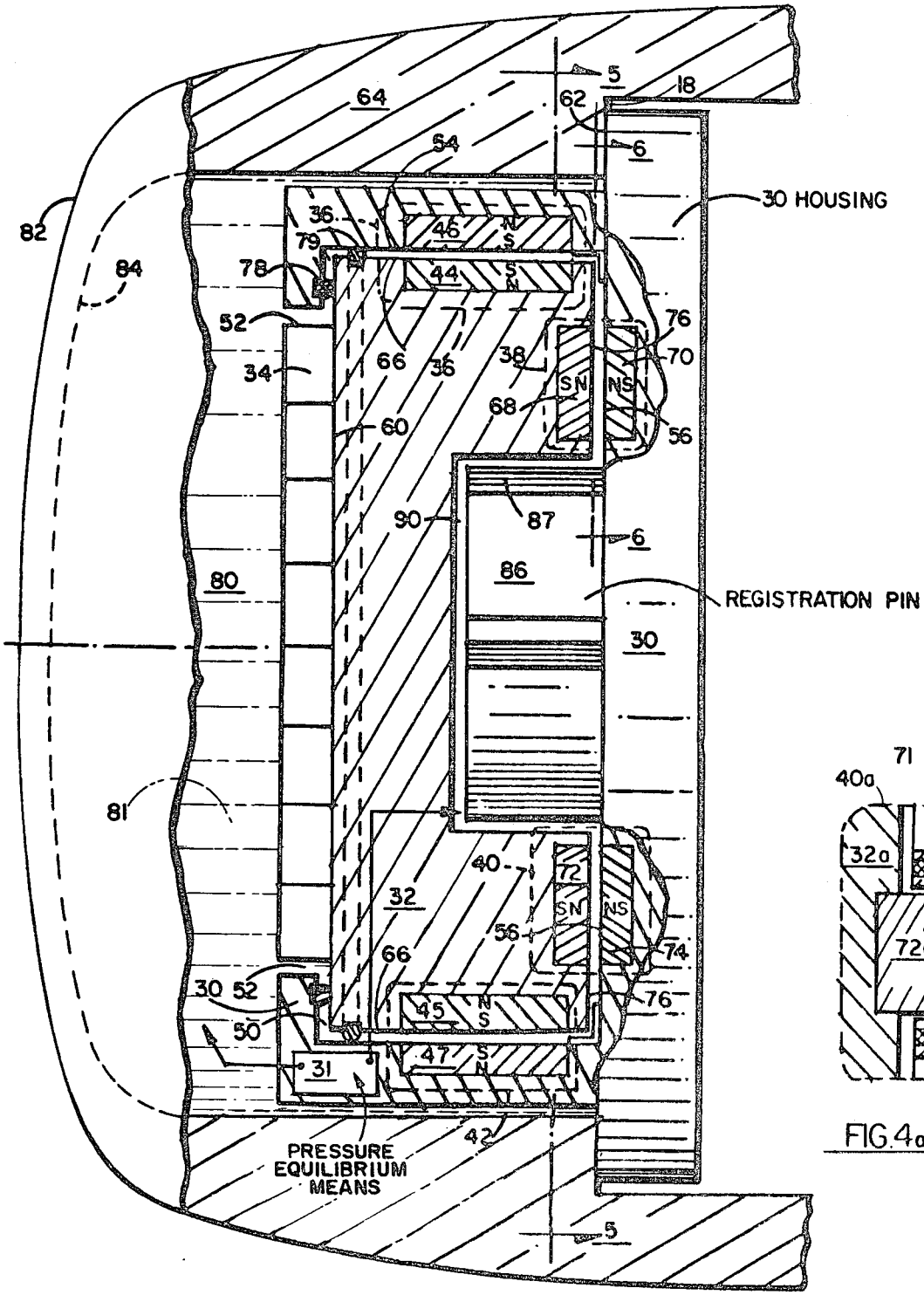
FIG. 4 is a view taken on line 4—4 of FIG. 2.

FIG. 2 and FIG. 3 are front and side elevation drawings of a housing 30 for use in a preferred embodiment of the sonar vibration isolation transducer mount. FIG. 4 is a cross-section taken along line 4—4 of FIG. 2 and positioned on flanges 60, 62 of the sectioned hull of a marine vehicle 64 such as a torpedo. Housing 30 is shown containing a mount 32 adapted to carry a transducer 34, the mount having a predetermined positional locus established by cooperating sets of magnets 36, 38, 40, 42; these sets of magnets acting to positionally bias the mount 32 toward an equilibrium position within the predetermined locus and freely of housing vibration transmittal to the mount 32.

Figure 4A:
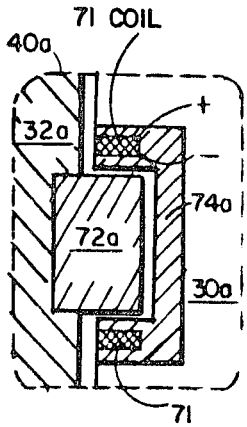
FIG. 4*a* is a sectional view of an alternative embodiment of an axial magnet subset depicting use of an electromagnet.

FIG. 4*a* shows electromagnet 71, having plus and minus coil leads, solenoid 72*a*, and core region 74*a*. The electromagnet, being installed in designated subset 40*a* and acting to provide a repelling force analogous to the repelling force provided by magnet subset 40 shown in FIG. 4. Region 32*a* is analogous to the mount region 32 and region 30*a* is analogous to the housing region 30.

It is known that diamagnetic materials provide a means for forming the flux field of permanent magnets and therefore provide a means for adjusting the resultant force of magnet pairs for the purpose of stabilizing the mount.

FIG. 4 shows marine vehicle 64 having an outer echo sensitive surface 82, an inner echo sensitive surface 84, a chamber 80, the chamber containing the housing 30, the mount 32 being positioned within the housing 30 and being relatively free of acoustical coupling between the housing and mount. Transducer 34 is positioned on the transducer mounting surface 60.

Cooperating sets of magnets 36, 38, 40, 42 are mutually repelling, each set of cooperating magnets having at least one magnet attached to the mount 32 and adapted and arranged to mutually repel one or more magnets attached to the housing 30. The sets of magnets act to bias the mount to an equilibrium position. The cooperating sets of magnets 36, 38, 40, 42 are mutually repelling and arranged in pairs, opposite polarity magnets being attached to the mount and housing respectively, each magnet pair, for example magnet 46 and magnet 44, magnet 68 and magnet 70, magnet 72 and magnet 74, magnet 45 and magnet 47 act to provide localized repulsive force between the mount and the housing.

Figure 5:
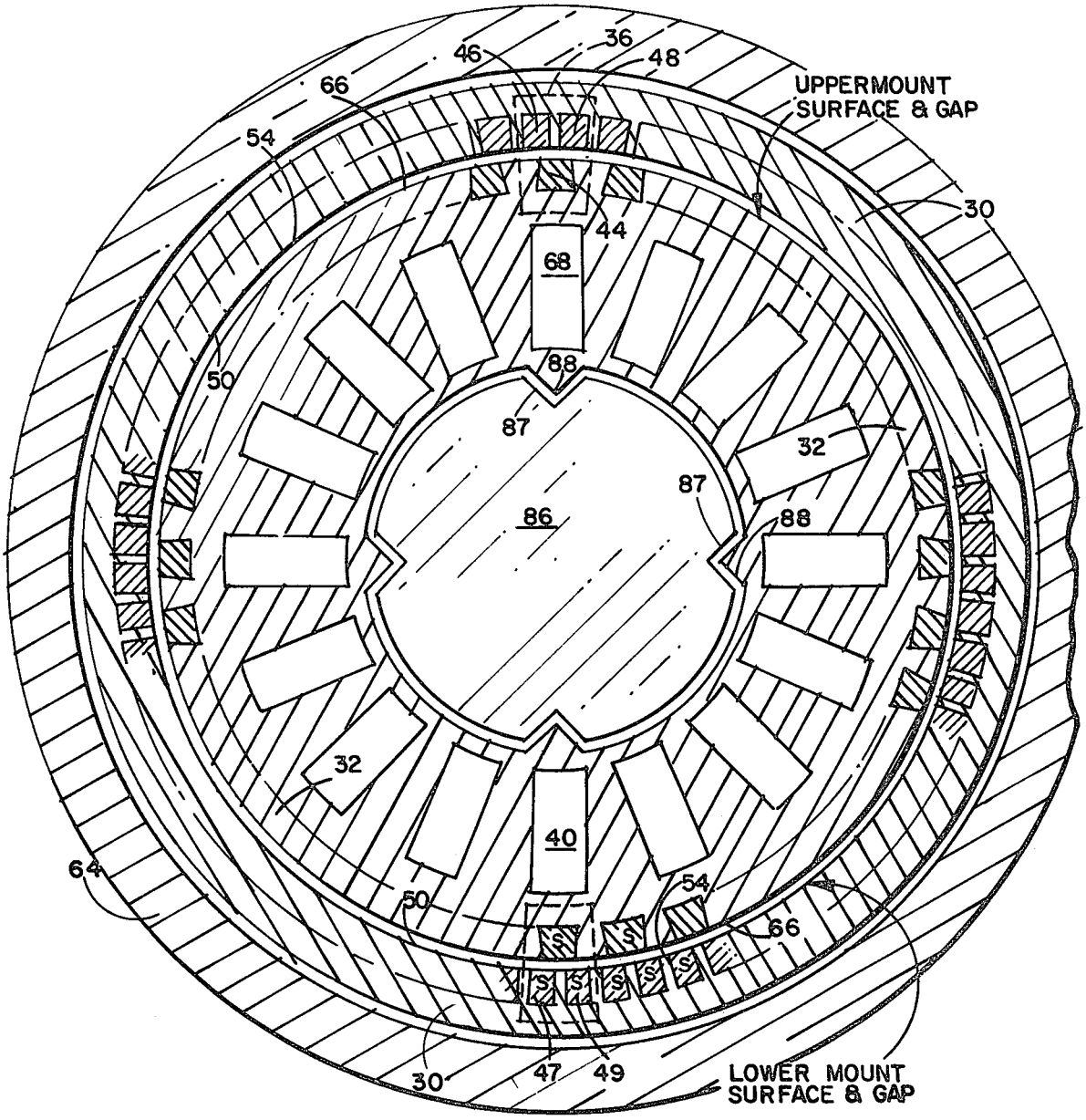
FIG. 5 is a view taken on line 5—5 of FIG. 3.

Cooperating sets of magnets 36, 42 are radial magnet subsets wherein each radial magnet subset comprises one or more magnets attached to the mount 32 and one or more magnets attached to the housing 30 and adapted and arranged to provide restoring torque to the mount with respect to the housing. Referring to FIG. 5 radial magnet subset 36 is shown comprising magnets 46, 48 on housing 30 and magnet 44 on mount 32. With magnet 44 positioned exactly between magnets 46 and 48 as shown, tangential forces applied to the mount are nulled resulting in a cancellation of rotational torque applied to the mount. A slight rotational displacement of the mount to the left or to the right produces a resulting torque tending to restore the mount to the null position. Radial magnet subset 42 comprising magnets 47, 49 attached to the housing 30 and magnet 45 attached to the mount 32 provide an identical function.

Referring to FIG. 4 the housing 30 defines a cylindrical cavity 50 having an aperture 52, and an inner cylindrical surface 54 and a base 56; wherein the mount 32 is located in the cylindrical cavity 50 and comprises a cylindrical mass having a transducer mounting surface 60, a mount cylindrical surface 66 opposing the cavity inner cylindrical surface 54, and a thrust support base 76 opposing the cylindrical cavity base 56. Each radial magnet subset 36, 42 having at least one inner radial magnet attached to the mount cylindrical surface 66, and at least one outer radial magnet attached to the cavity inner cylindrical surface 54. Referring to FIG. 5, the inner radial magnets 44, 45 and others and the outer radial magnets 46, 36, 49, 47 and others form concentric arrays of opposing subset magnets. Each subset of magnets act to bias the mount toward equilibrium. Gravity acts on the mount to diminish the gap between the lower mount cylindrical surface and the lower cavity inner cylindrical surface, region 50 until the repulsion force produced by the radial magnet pairs of the lower half of the concentric arrays counterbalances the diminishing force resulting from the radial magnets in the upper half of the concentric arrays plus the weight of the mount. Equilibrium is possible because the repulsive force produced by respective radial magnet pairs obeys a square law relationship.

Figure 7:
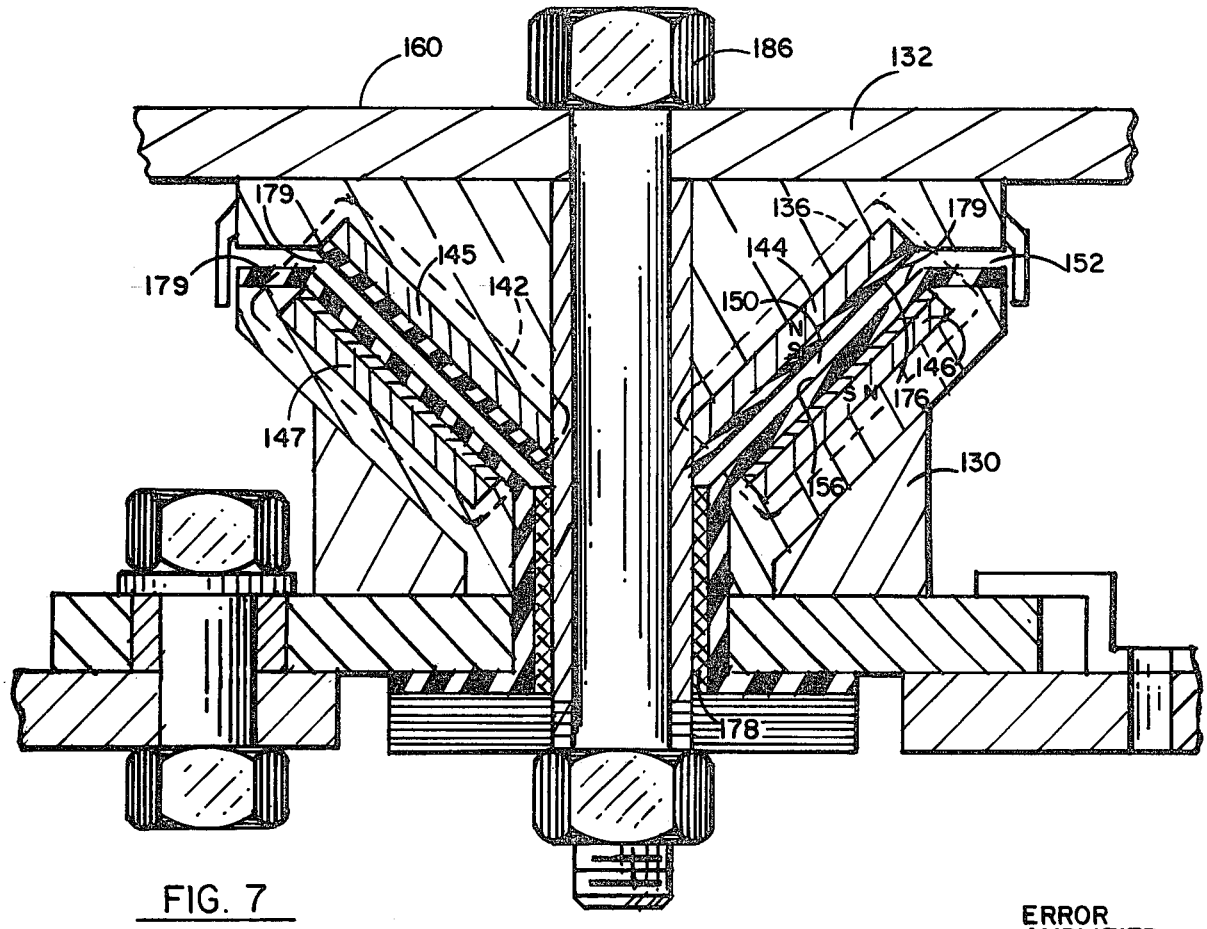
FIG. 7 is a sectional view of an alternate embodiment of the invention sonar vibration isolation transducer mount.

Referring to FIG. 7 housing 130 defines a conical cavity having an aperture 152, an inner conical cavity surface 156; wherein the mount 132 is disposed within the conical cavity 156 and comprises a conical mass having a transducer mounting surface 160, a mount thrust support conical surface 176 opposing the inner conical cavity surface 156, each radial magnet subset 136, 142 having at least one inner radial magnet 144, 145 attached to the mount thrust support conical surface 176, and at least one outer radial magnet 146, 147 attached to the inner conical cavity surface 156, the inner and outer radial magnets forming concentric conical arrays of opposing subset magnets, each subset of magnets adapted and arranged to mutually repel and to provide restoring torque to the mount with respect to the housing and to bias the mount toward an equilibrium position within the predetermined locus and freely of housing vibration transmittal to the mounting.

Referring again to FIG. 4, compliant spacer means are required to concentrically and axially position the cylindrical mount and to provide a seal at the housing forward circular aperture 52. Elastomer seals or seals of low durometer rubber such as O-rings 78, 79 concentrically and radially position the cylindrical mount 32 within the housing 30 at the housing forward circular aperture 52 within the locus and freely of housing vibration transmittal to the mounting.

Mount thrust support base 76 is recessed 90 to receive housing cavity base registration pin 86. Referring to FIG. 5 registration pin 86 is shown to be loosely keyed 87, 88 to mount 32. The keyed pin is adapted to provide mechanical registration of the mount 32 in relation to the housing 30, limiting the mount rotational and translational freedom within the housing and providing initial magnet pair alignment. In an alternate embodiment the keyed relationship between the mount 32 and the housing 30 is adjustable to permit maximization of rotational freedom under quiescent or transient shock conditions.

In another embodiment, means are provided to detect a pressure difference between the chamber 80 and the inner cylindrical cavity 50 and to act to establish pressure equilibrium between chamber 80 and all regions 50, 90 between the mount and the housing. Block 31 represents a "means for establishing pressure equilibrium" between chamber 80 and regions 50, 90.

Figure 6:
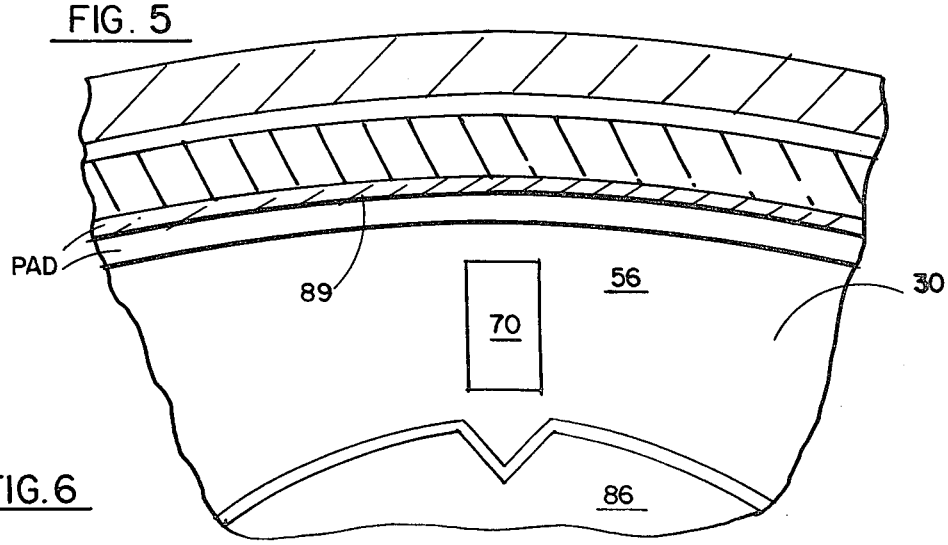
FIG. 6 is a view taken along line 6—6 of FIG. 4.

Referring to FIG. 6, a cross-sectional view along line 6—6 of FIG. 4, magnet 70 is embedded in housing cavity base 56. Travel limit pad 89 is attached to base 56. Limit pad 89 is typically made of steel mesh or low durometer rubber. As mount 32 obtains positional equilibrium in relation to housing 30, no contact exists between the travel limit pad 89 and mount 32.

Figure 8:
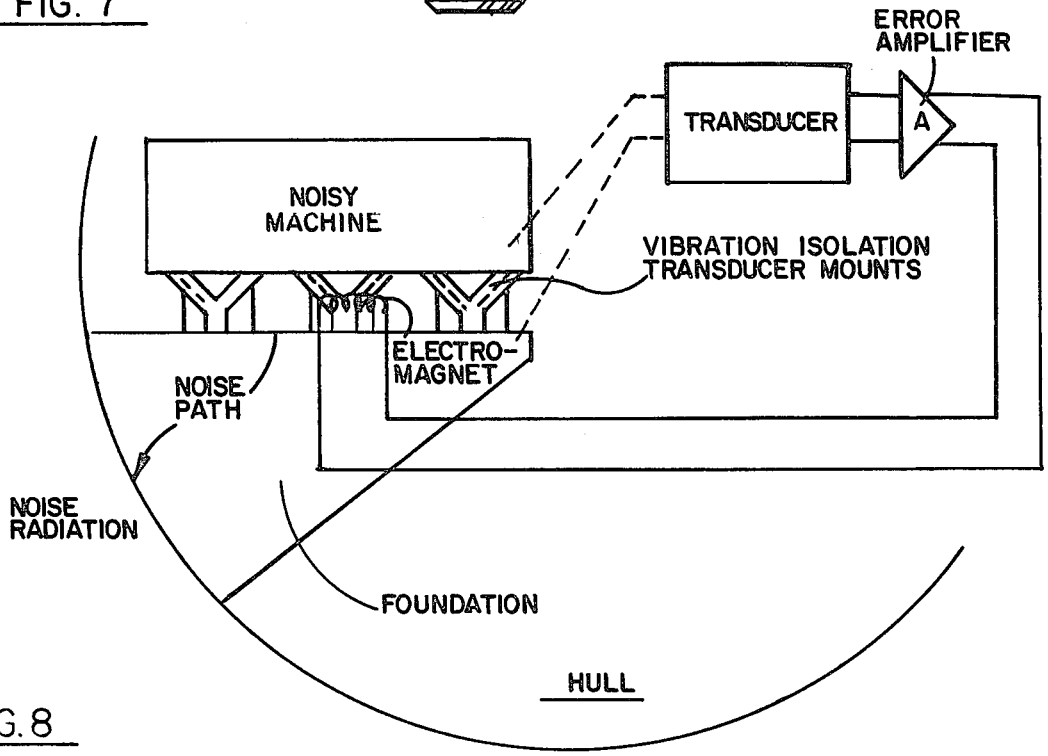
FIG. 8 is a schematic view showing an application of the alternate embodiment vibration isolation transducer mount shown in FIG. 7.

Referring to FIG. 8, a schematic relating an alternate use of an isolation mount of the type shown in FIG. 7 appears in which an electromagnet is depicted. The positional relationship between the mount supporting a noisy machine and the noise pad or frame is monitored by a transducer providing an electrical error signal to an error amplifier (A) that operates to provide sufficient power to the electromagnet to null the transducer error signal. This apparatus is intended to illustrate in block diagram form an electronic control means for the electromagnet pair used to bias the mount toward an equilibrium position.

Referring to FIG. 7, spacer 178 positions bolt 186 in relation to housing 130 and is typically made of stainless steel mesh or low durometer rubber. Mount travel limit pads 179 are typically of low durometer rubber also.

It is believed that the necessary magnet forces can be achieved by using permanent magnets of the rare-earth type which are now readily available on a commercial scale. These magnets can achieve large repulsive forces with minimum amounts of material because of their inherently high residual induction flux levels and high energy product. They are also very stable, indefinitely retaining magnet properties because of their very high coercive force. The best known of the rare-earth cobalt magnets is samarium cobalt ($SmCo_5$).

The description provided is intended to be illustrative only and is not intended to be limitive. Those skilled in the art may conceive of modifications which fall within the purview of the description. These modifications are intended to be included therein as well. The scope of this invention shall be determined from the scope of the following claims including their equivalents.

We claim:

1. A sonar mount for use in a marine vehicle, the vehicle having an outer echo sensitive surface, an inner echo sensitive surface, a chamber; said sonar mount comprising:

a housing, having an aperture and a longitudinal axis normal to said aperture, said chamber containing said housing, a mount having a longitudinal axis and having a transducer mount surface, a transducer array coupled to said transducer mount surface and having a sensitive axis normal to said transducer mount surface, said mount being positioned within said housing, the longitudinal axis of said mount being relatively parallel to the longitudinal axis of said housing, said sensitive axis of said transducer array being directed toward said inner echo sensitive surface, said transducer array being exposed to said inner echo sensitive surface by said housing aperture, cooperating sets of magnets attached to said mount and said housing respectively, each set of cooperating magnets having at least one magnet attached to said mount and at least one magnet attached to said housing, each magnet attached to said mount being positioned to mutually repel one or more magnets attached to said housing, said sets of magnets acting to position said mount to an equilibrium position within said housing, said mount being relatively free of structure born housing vibration transmittal to said mount by a space between said mount and said housing.

2. The apparatus of claim 1, wherein one or more magnets of said subsets of magnets are permanent magnets.

3. The apparatus of claim 1, wherein one or more of said cooperating sets of magnets are electromagnets.

4. The apparatus of claim 1, wherein one or more of said magnets are formed of diamagnetic material.

5. The apparatus of claim 1, wherein said cooperating sets of magnets are arranged in pairs to form magnet pairs, each magnet pair having, opposite polarity magnets attached to said mount and housing respectively, each said magnet pair acting to provide a localized repulsive force between said mount and said housing, said force positionally biasing said mount toward an equilibrium position and relatively free of structure born housing vibration transmittal to said mount.

6. The apparatus of claim 5, further comprising at least one radial magnet subset wherein each said radial magnet subset comprises one or more magnets attached to said mount and one or more magnets attached to said housing, each magnet attached to said mount being positioned on said mount to be repelled by at least one magnet attached to said housing to provide restoring torque to said mount with respect to said housing to bias said mount toward an equilibrium position and relatively free of structure born housing vibration transmittal to said mount.

7. The apparatus of claim 6, wherein said housing defines a cylindrical cavity having an aperture, an inner cylindrical surface and a base; wherein said mount is disposed within said cylindrical cavity and comprises a cylindrical mass having a transducer mounting surface, a mount cylindrical surface opposing said cavity inner cylindrical surface, and a thrust support base opposing said cylindrical cavity base, each radial magnet subset having one or more inner radial magnets attached to said mount cylindrical surface, and one or more outer radial magnets attached to said cavity inner cylindrical surface, said inner and outer radial magnets forming concentric arrays of opposing subset magnets, each subset of magnets acting to bias said mount toward said equilibrium position and relatively free of structure born housing vibration transmittal to said mount.

8. The apparatus of claim 7, further comprising an axially disposed array of magnet subsets, each axial magnet subset having one or more magnets being attached to said thrust support base and one or more magnets being attached to said cylindrical cavity base, said axial array of magnet subsets acting to position said mount thrust support base axially from said cavity base toward said equilibrium position and relatively free of structure born housing vibration transmittal to said mount.

9. The apparatus of claim 8, wherein one or more magnets of said subsets of magnets are permanent magnets.

10. The apparatus of claim 9, further comprising compliant spacer means to concentrically and axially position said cylindrical mount and to provide a seal at said housing forward circular aperture, said spacer means providing radial and axial restoring force in response to radial or axial mount displacement in relation to said housing thereby biasing said mount toward an equilibrium position and relatively free of structure born housing vibration transmittal to said mount.

11. The apparatus of claim 10, wherein said compliant spacer means to concentrically and radially position said cylindrical mount within said housing at said housing forward circular aperture further comprises at least one circular elastomer seal positioned to bias said mount toward an equilibrium position and relatively free of structure born housing vibration transmittal to said mount.

12. The apparatus of claim 11, wherein said mount thrust support base is recessed and wherein said housing cavity base has at least one registration pin, said mount thrust support base recess being adapted to receive said registration pin, said pin interlocking with said recess and adapted to provide mechanical registration of said mount in relation to said housing, limiting said mount rotational and translational freedom within said housing and providing magnet pair alignment.

13. The apparatus of claim 12, wherein one or more of said magnet pairs are electromagnets.

14. The apparatus of claim 13, further comprising control means for said electromagnet pairs to bias said mount toward an equilibrium position with said locus and relatively free of structure born housing vibration transmittal to said mount.

15. The apparatus of claim 12, wherein said registration pin is loosely keyed to said mount to limit said mount rotational freedom.

16. The apparatus of claim 1, having means for providing pressure equilibrium between said chamber and all regions between said mount and said housing.

17. A sonar mount for use in a marine vehicle, said vehicle having an outer echo sensitive surface, an inner echo sensitive surface and a cylindrical chamber, said sonar mount comprising:

a cylindrical housing having an aperture and a base, said cylindrical housing being positioned in said cylindrical chamber, a cylindrical mount having a transducer mounting surface, at least one transducer, said transducer being coupled to said transducer mounting surface, said cylindrical mount being concentrically positioned within said housing and orientated to expose said transducer to said inner echo sensitive surface, cooperating sets of repelling magnets, each cooperating set of magnets having a first respective magnet attached to said cylindrical mount and at least one second magnet, each respective second magnet being attached to said cylindrical housing, said cooperating sets of repelling magnets acting to positionally bias said cylindrical mount toward an equilibrium position, said cylindrical mount being relatively free of said structure born cylindrical housing acoustical vibration transmittal to said cylindrical mount, each respective magnet of each respective cooperating sets of magnets being permanent magnets;

whereby, structure born mechanical vibration passing from said marine vehicle to said cylindrical chamber and thence to said cylindrical housing, and thence to said cylindrical mount is attenuated by a space between said cylindrical mount and said cylindrical housing, said cylindrical mount being located by operation of said cooperating sets of magnets within said equilibrium position in said cylindrical housing, relatively free of said cylindrical housing.

* * * * *